United States Patent [19]

Berlik et al.

[11] 4,114,589

[45] Sep. 19, 1978

[54] OPTIONAL DISCHARGE OVEN VENT

[75] Inventors: Lee Berlik, Cleveland; James E. Hurley, Chattanooga, both of Tenn.

[73] Assignee: McGraw-Edison Company, Elgin, Ill.

[21] Appl. No.: 788,692

[22] Filed: Apr. 18, 1977

[51] Int. Cl.[2] ..... F24C 15/32

[52] U.S. Cl. ..... 126/21 R; 126/273 A

[58] Field of Search ..... 126/21 R, 21 A, 273 A, 126/299 R, 299 D, 289, 290, 292; 98/115 VM; 55/DIG. 36

[56] References Cited

U.S. PATENT DOCUMENTS

| | | | |
|---|---|---|---|
| 2,868,108 | 1/1959 | Petersen | 55/DIG. 36 |
| 2,886,124 | 5/1959 | Scharmer | 126/299 D |
| 3,051,158 | 8/1962 | Kimberley | 126/299 R |

*Primary Examiner*—Alan Cohan

*Attorney, Agent, or Firm*—Ronald J. LaPorte; Jon Carl Gealow; Thomas McDonald

[57] ABSTRACT

A venting system for a food processing oven includes a duct assembly comprising a housing defining an inlet into which heated air from the oven enters and first and second outlets through which the heated air is expelled to the interior or exterior, respectively, of the household in which the oven is installed. A serpentine channel formed by a series of parallel plates mounted in the housing between the inlet and outlets is provided to carry the heated air over a relatively long path to cool, permitting water vapor therein to condense on the plates before the air is expelled. A damper plate is mounted in the housing for pivotal movement in the path between the inlet and second outlet. A manual selector movable to first and second positions is coupled to the damper plate for movement thereof to blocking and unblocking positions, respectively, with respect to the second outlet. Movement of the selector to the first position permits the air to pass to the interior of the household via the first outlet, and movement to the second position permits the air to be discharged via the second outlet to the household exterior. The damper plate is biased normally to the unblocking position. An actuator mechanism coupled between the manual selector and damper plate, controls the position of the latter in response to the operation of the manual selector.

9 Claims, 7 Drawing Figures

FIG. 1
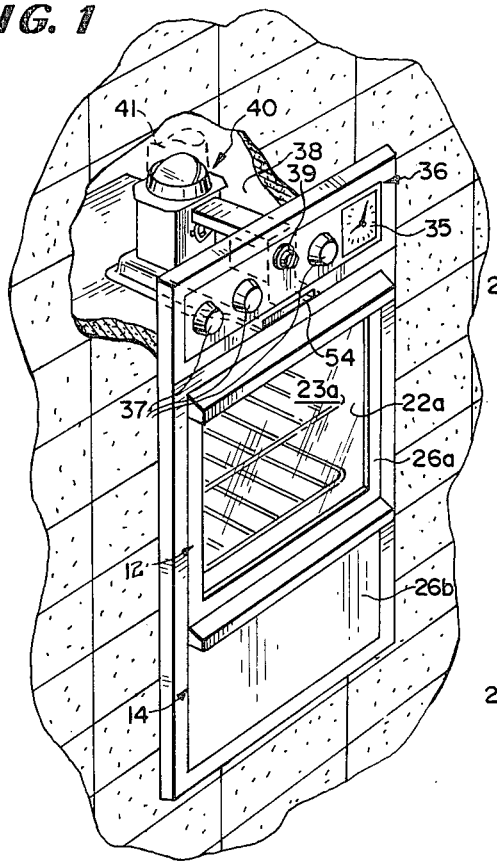
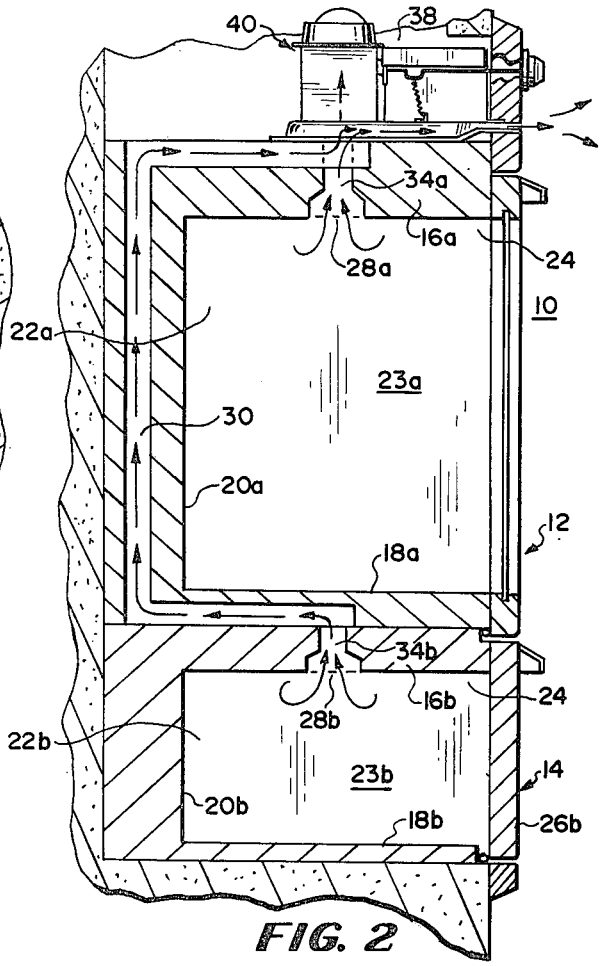
FIG. 2
FIG. 3
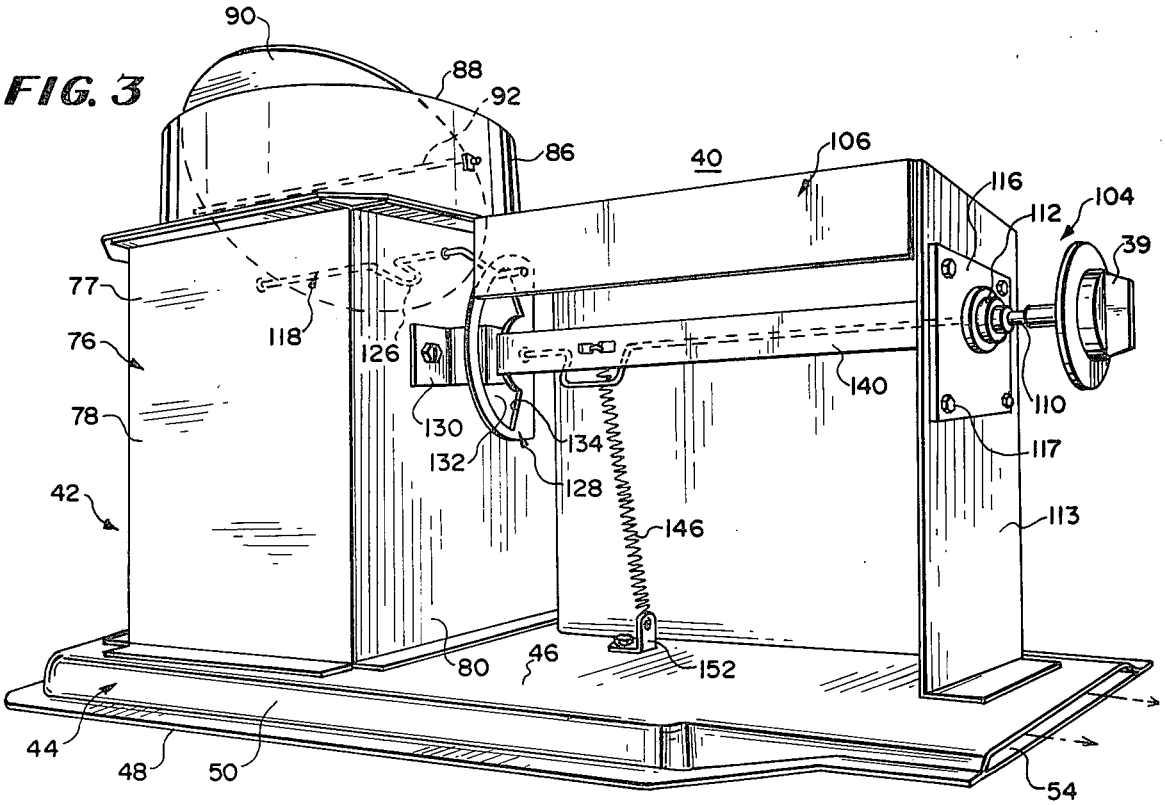

FIG. 4
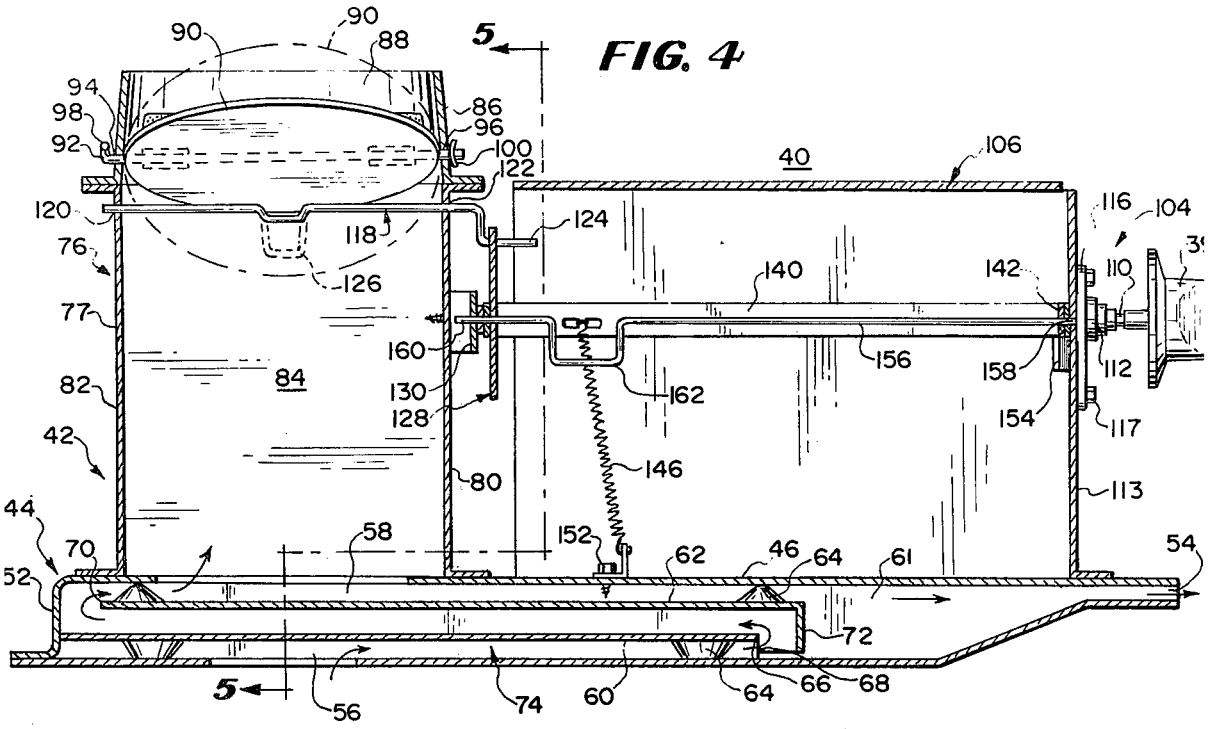
FIG. 5
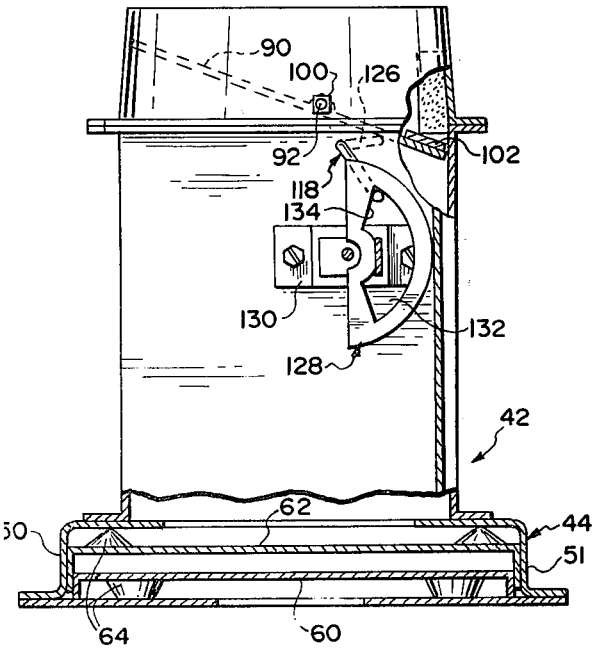
FIG. 6
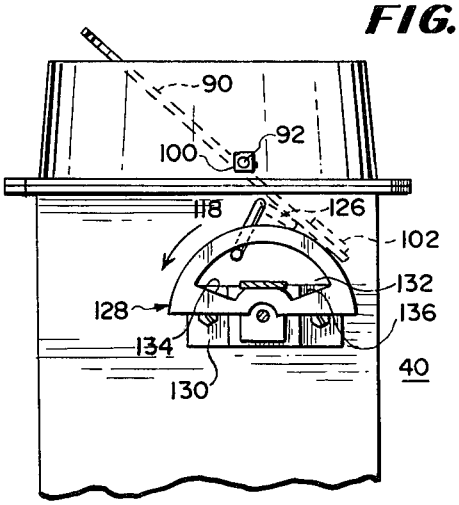
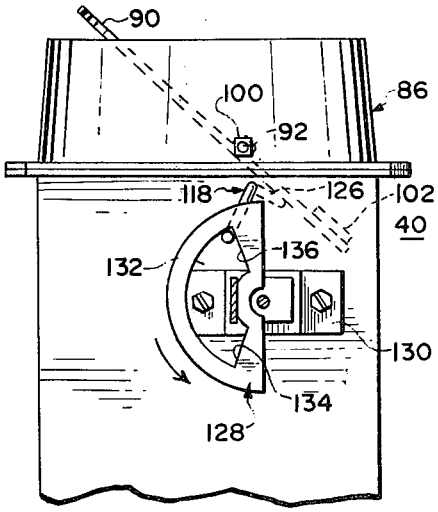
FIG. 7

OPTIONAL DISCHARGE OVEN VENT

BACKGROUND OF THE INVENTION

This invention relates generally to domestic food processing ovens and more particularly to a venting system for such ovens which carries heated air produced therein during a cooking or cleaning cycle, either to the outside of the household or into the room in which the oven is located.

Presently available venting systems for food processing ovens both of the built-in and free standing type, can be installed to direct heated air created in the oven during cooking or cleaning, either to the outside of the household through suitable ducting, or into the kitchen where the oven is located. Some examples of such venting systems are illustrated in U.S. Pat. Nos. 3,719,137 and 3,422,809, where upon installation, ducting is arranged to carry oven heated air either to the outside or into the room.

The prior art oven venting systems described have the drawback that once the installation thereof is completed, the user cannot then select a different mode of venting of the oven heated air without a major alteration of the system. Consequently, the user loses the advantage of selectively directing the heated air to the location whereat it could be beneficial. For example, in the winter season, it is desirable to permit the heated oven air to enter the household for added warmth. On the other hand, in the summer season, one would want to dispose of the heated air by venting it to the outside so as to maintain the household interior as cool as possible.

SUMMARY OF THE INVENTION

Accordingly, it is a primary object of the present invention to provide a new and improved venting system for a food processing oven which overcomes the drawbacks of the prior art oven venting systems described.

It is another object of the invention to provide an improved venting system of the last mentioned type wherein means are provided for selecting the disposition of heated air vented from a food processing oven.

A preferred embodiment of a venting system for a food processing oven or the like cooking appliance according to the invention, comprises a duct assembly which includes a housing having a first portion defining an inlet into which heated air from the oven enters, a series of parallel plates arranged to provide a serpentine channel through the housing portion which carries the heated air along a defined path and first and second outlets at the end of the channel through which the heated air is expelled. The channel causes the heated air to be carried over a relatively long path permitting water carried by the heated air to condense on the plates forming the channel.

A first one of the outlets expels the heated air from the first housing portion into the household interior and the second outlet expels the heated air into a second housing portion coupled joined the first housing portion. In the preferred embodiment, the second housing portion takes the form of a duct of standard dimension, coupled to conventional exhaust ducting which carries the heated air to the exterior of the household. Within the duct of the second housing portion is mounted a damper plate. The plate is pivotal between a first position blocking the duct and a second position whereby the duct is open to permit the passage of heated air. A weight placed on one end of the damper plate normally biases the plate to the open position. The weight is sufficiently light to permit the damper plate to be pivoted to a closed position in the event back pressure is created in the exterior exhaust ducting.

Control means accessible on the front panel of the oven are coupled to the damper plate for selectively moving the latter to one of its two positions, thereby venting the oven through a corresponding outlet. The control means comprises a control shaft coupled to a knob mounted on the front panel of the oven for manual rotation. Actuator means coupled to the opposite end of the shaft causes the damper plate to be moved between the open and closed positions. The actuator means includes an actuator member connected to the control shaft for rotation therewith and a pivotally mounted rod extending through the duct of the second housing portion. The rod is pivoted by the actuator member into engagement with the damper plate to move the plate to a closed position or out of engagement therewith to release the damper plate for movement to an open position.

DESCRIPTION OF THE DRAWINGS

In the drawings:

FIG. 1 is a perspective view of a built-in-the-wall food processing oven assembly which has been partially broken away to illustrate the venting system therefrom according to the invention;

FIG. 2 is a side sectional view of the food processing oven assembly of FIG. 1;

FIG. 3 is a perspective view of the duct assembly included in the venting system according to the invention for selectively controlling the discharge of oven heated air to the exterior or interior, respectively, of the household in which the food processing oven assembly is installed;

FIG. 4 is a side sectional view of the duct assembly of FIG. 3;

FIG. 5 is a sectional view of the duct assembly of FIG. 4 taken along the line 5—5; and FIGS. 6 and 7 are fragmentary views of the damper plate and actuator member of the duct assembly of FIG. 5 illustrating the operation of the actuator member to control the position of the damper plate.

DETAILED DESCRIPTION OF THE DRAWINGS

Referring now to the drawings in greater detail wherein like numerals have been employed throughout the various views to designate similar components, there is illustrated in FIG. 1, a built-in-the-wall type oven assembly, designated generally by the numeral 10, which includes both lower and upper food processing ovens 12, 14, respectively. Each of the ovens includes an insulated upper wall **16*a*, 16*b*, a lower wall 18*a*, 18*b*, a rear wall 20*a*, 20*b* and side walls, only one 22*a*, 22*b* of which is shown, defining interior oven cavities 23*a*, 23*b*, respectively. A front access opening 24*a*, 24*b* for each oven is closed off by an insulated, hingedly mounted door 26*a*, 26*b*, respectively. Each of the oven cavities 23*a*, 23*b* is vented at the top via an opening 28*a*, 28*b*, respectively, provided in the upper walls 16*a*, 16*b* of the ovens. Suitable sheet metal or the like ducting 30 is provided to vent the lower oven 14 for discharge of heated air at a location common to that of the expulsion of the heated air from the upper oven 12**, via opening 28*a*. Smoke eliminators 34*a*, 34*b* are provided at the vent openings 28*a*, 28*b*, respectively, of the ovens for catalytically removing smoke and the like materials from the heated air expelled from the ovens.

A control panel 36 is provided directly above the oven door 26*a* of the upper oven. The panel includes the usual clock 35, operating dials and knobs 37 for controlling the heating means, whether gas or electric, of the ovens as well as a manual control knob 39 for selecting the disposition of the heated air from the ovens 12, 14 to the interior or exterior of the house, respectively. A cavity 38 is provided directly behind the front panel and above the upper wall 16*a* of the upper oven. A duct assembly 40 according to the invention included in the venting system for the food processing ovens 12, 14, is mounted in the cavity 38. The duct assembly permits selective discharge of the heated air being expelled from the ovens, either into the room of the household in which the oven is located, or to the exterior of the household via suitable ducting 41 (shown in dotted lines in FIG. 1).

The duct assembly 40 which is illustrated in greater detail in FIGS. 3–7 of the drawings, comprises a substantially enclosed housing 42 formed of sheet metal or other suitable material. The housing 42 includes a first, lower portion 44 having an upper wall 46, a lower wall 48, a pair of side walls 50, 51 and a rear wall 52. The lower wall 48 is shaped at the end opposite the rear wall to form with the upper wall 46, a first outlet 54. As shown in FIG. 1 of the drawings, outlet 54 is in direct communication with the interior of the room of the household in which the oven is located and as such also comprises the first outlet of the vent system. The lower wall 48 defines an aperture 56 forming an inlet to the first housing portion and the upper wall 46 defines an aperture 58 forming a second outlet therefor.

Within the interior 61 of the first housing portion 44 of the duct assembly 40, is provided a pair of parallel plates 60, 62. The plates are mounted on standoffs such as 64 formed thereon and secured by welding or the like to the interior of the upper and lower walls 46, 48, respectively of the housing portion (see FIGS. 4 and 5). The lower plate 60 abuts the interior surface of end wall 52 of the housing portion. The opposite end 66 (FIG. 3) of plate 60 is spaced from lower wall 48 to form an open end 68. The upper plate is spaced at end 70 thereof from end wall 52 and includes a descending portion at the opposite end engaging the interior surface of lower wall 48 but spaced from the end 66 of the plate 60. The positioning of the plates as described provides a "serpentine" channel 74 therebetween which carries heated air expelled from the ovens 12, 14 into inlet 56, to outlets 58 and 54, respectively, as shown by the arrows (FIG. 4). The channel is provided to carry the oven heated air along a relatively long path and not directly to the outlets. In this manner, the heated air cools as it passes over the parallel plates 60, 62 thereby permitting vapor carried by the air to condense on the plates.

A second, upper housing portion 76 is joined to the first housing portion at outlet 58 thereof. The second housing portion in a preferred embodiment of the duct assembly, includes a generally square duct section 77 having joined side walls 78, 80, 82 and 84 (see FIGS. 3 and 4) with a generally cylindrical duct section 86 attached thereto at the free end thereof. It should be understood that the second housing portion can be of a dimension and shape other than that shown and still fall within the scope of the present invention.

As can be seen in FIG. 4, the duct sections 77 and 86 are joined together, preferably by welding, and the duct section 77 is likewise preferably welded to the upper wall 46 of the first housing portion. The open end of the second housing portion provides a second outlet 88 for the duct assembly 40. Additional ducting 41, FIG. 1, is attached to duct section 86 at the outlet 88 thereof and carries oven heated air discharged therefrom to the exterior of the household.

Mounted in the cylindrical duct section 86 of the second housing portion is a damper plate 90. The plate is circular in shape having a diameter just slightly smaller than that of the cylindrical duct section 86. The plate is received in the cylindrical duct section as shown in FIGS. 3–7.

Damper plate 90 is attached to a rod 92 extending along the diameter thereof. The ends of the rods extend through diametrically opposing apertures 94, 96 (FIG. 4) in the wall of the duct section 86. One end 98 of the rod is bent and a fastener 100 is provided at the opposite end thereof to secure the damper plate in position as shown.

The damper plate 90 is pivotal on the rod 92 between a first closed position whereby it is in a blocking relation with respect to the second housing portion and a second open position whereby it is in an unblocking relation with respect to the housing portion. Such positions are illustrated in FIGS. 5 and 7, respectively, of the drawings. A weight 102 is provided at one edge of the damper plate to normally bias the plate to an open position.

With the damper plate 90 in a closed position, oven heated air entering the inlet 56 of the duct assembly passes via channel 74 to outlet 54, thereby discharging the heated air into the household interior. Upon opening the damper plate 90, the oven heated air is free to escape through outlet 88 of the duct assembly to the exterior of the household. Because heated air rises, there is a tendency for the air to be expelled via outlet 88 rather than outlet 54. In the event a back pressure from the outdoors is created in the ducting 41 connecting outlet 88 with the household exterior, the freely pivotal damper plate 90 will be closed thereby to prevent the reverse flow of air into the duct assembly.

Suitable control mechanism 104 to be described, is provided for selectively moving the damper plate between the open and closed positions. The control mechanism 104 is mounted on a support member 106 attached, preferably by welding to the top wall 46 of the first housing portion adjacent the second housing portion 77. The control mechanism includes control knob 39 mounted on a relatively short shaft 110 for rotation. The shaft is received in the bearing assembly 112 coupled to a support plate 116. Support plate is attached by suitable fasteners 117 to a first wall 113 of the support member 106. The end of the rotatable shaft extends through an aperture provided in the wall 113 (see FIG. 4).

A damper plate actuator rod 118 is mounted directly beneath the damper plate 90 for rotating on the duct section 77 of the second housing portion 76. The ends of the rods are received in apertures 120, 122 in opposite walls 72, 80, respectively, of the duct section 77. One end 124 of the actuator rod extends outwardly from wall 80 as shown in FIG. 4. The actuator rod is bent to include a portion 126 which extends transverse the axis of the rod and is rotated thereabout upon rotation of the rod in apertures 120, 122. The rod portion 126 is located adjacent the weighted edge of the damper plate for engagement therewith. Thus when the rod is rotated as described, the damper plate is urged to a closed position. Disengagement of portion 126 with the damper plate, permits the latter to be rotated by the gravitational pull on the weight 102, to its open position.

To produce rotation of the actuator rod 118 as described, there is provided an actuator member 128 mounted for 180° rotation on a support 130 attached to side wall 80 of the duct section 77 of the second housing portion. The actuator member 128 as can be seen in the drawings, includes an arcuate slot 132 into which the end 124 of the actuator rod 118 is inserted. Rotation of the actuator member to a first position (FIG. 5) causes the rod end 124 to be engaged at a first edge 134 defining the arcuate slot thereby to rotate the actuator rod 118 so that portion 126 thereof engages the damper plate 90 thereby closing the latter with respect to outlet 88. Rotation of the actuator member 128, 180° in the opposite direction causes the opposite edge 136 of the actuator member defining slot 132 to engage the rod end 124 thereby rotating the rod portion 126 out of engagement with the damper plate, permitting the latter to open outlet 88.

The actuator member 128 is coupled to knob 39 for rotation thereby, by an interconnecting member 140. One end 142 of the member 140 is attached to the end of the shaft 110 extending through wall 113 of the support member 106 and the opposite end 144 of the member 140 is attached to the actuator member 128. The central portion of the member 140 is offset with respect to the axis of rotation of shaft 110 and actuator member 128. A coil spring member 146 couples the member 140 to a bracket 152 mounted on the top wall 46 of the first housing portion of the duct assembly. The use of the offset connecting member 140 and spring 146 serves as an over center device to positively move the actuator member to either of its two positions in response to the rotation of knob 39. The spring also serves to maintain the actuator member securely in the selected position. Stops 154 (FIG. 4) are provided adjacent connecting member 140 to limit the rotation thereof.

A rod 156 extends between the ends of connecting member 140 with the rod ends 158, 160 passing through apertures in respective ends 142, 144 thereof, to provide a pivot for the connecting member 140. A bend 16 in the rod 156 accommodates spring 146. It should be noted that other suitable over center connecting arrangements could be used in place of the device described. The latter, however, is of relatively low cost and efficient in operation.

Briefly, the operation of the duct assembly employed in the system for venting the food processing ovens of FIG. 1, is as follows:

When it is desired to vent the oven heated air from either or both of the food processing ovens 12, 14, into the interior of the household, knob 39 is rotated to move the damper plate 90 to the closed or blocking position in the second housing portion 76 of the duct assembly. In this case, rotation of the knob causes the actuator member to be rotated to a first position for engagement with the actuator rod 118 along a first edge 134 of the actuator member. In response thereto the actuator rod 118 is rotated, moving portion 126 thereof into engagement with the damper plate 90 thereby rotating the last-mentioned damper plate into a closed or blocking position in the duct 86. Closing of the damper plate prevents heated air from the ovens exiting outlet 58 of the first housing portion from passing through outlet 88 of the duct assembly to the household exterior. Rather, the heated air from the food processing ovens will be carried via channel 74 in the first housing portion to the outlet 54 for discharge into the interior of the household. The closing of the damper plate would normally be desirable, for example, in the winter season when added warmth to the household interior is required. Because smoke eliminators 34 are provided in the food processing ovens 12 and 14, only relatively clean heated air from the ovens will be discharged from vent outlet 54.

On the other hand, in the summer season one might want heated air from the oven to be discharged to the exterior of the household. In this case, the selector knob 39 is rotated 180°, thereby in turn rotating actuator member 128 which engages the actuator rod 118 along the edge 136 thereof to disengage portion 126 of the actuator rod from damper plate 90. In response thereto, damper plate 90 is permitted to rotate to an open position, permitting heated air from the ovens passing through outlet 58 of the first housing portion, to be discharged via outlet 88 and ducting 41 to the household exterior.

In the event back pressure is produced in the ducting 41 (FIG. 1) connecting duct section 86 to the household exterior, the freely pivotal damper plate 90 will be closed, thereby preventing any outdoor air from entering the household via outlet 54.

While a particular embodiment of the invention has been shown and described, it should be understood that the invention is not limited thereto as many modifications thereof may be made. It is therefore contemplated to cover by the present application any and all such modifications as fall within the true spirit and scope of the appended claims.

We claim:

1. A venting system for expelling heated air from a food-processing oven or the like cooking appliance selectively to one of the exterior and interior of the household in which the oven is installed, said venting system including:

a duct assembly comprising a substantially enclosed housing, said housing defining an inlet and first and second outlets, said inlet being in communication within an exhaust outlet of said oven, said first outlet being in communication with one of said household interior and exterior and the second outlet being in communication with the other of said household interior and exterior, duct means having a predetermined cross sectional dimension defined in said housing between one of said first and second outlets and said inlet, a damper plate dimensioned similarly to the cross sectional dimension of said duct means, mounted in the latter for controlling the passage of the heated oven air expelled from said oven to said first and second outlets, said plate being movable between a first position across the flow of air through said duct means for blocking the latter and a second position, generally in the direction of the flow of air through said duct means for unblocking the latter, means for biasing said damper plate to the second, unblocking position, and damper plate actuator means mounted adjacent the damper plate, said damper plate actuator means being operable to a first position to move said damper plate to said first, blocking position and being operable to a second position to permit said damper plate to be biased to said second, unblocking position.

2. A venting system as claimed in claim 1 wherein said biasing means includes a weight provided on said damper plate to hold said plate normally in said unblocking position.

3. A venting system as claimed in claim 1 wherein said damper plate actuator means includes an actuator rod mounted on said duct means adjacent said damper plate, said actuator rod being rotatable and including a portion movable upon rotation of said rod, into engagement with said damper plate thereby to move the latter to said first, blocking position, and movable out of engagement with said damper plate to permit said plate to move to said second, unblocking position, and an actuator member mounted on said duct means for rotation, said actuator member engaging said actuator rod in a first relation upon rotation of said actuator member to a first position, thereby to move said damper plate to said first, blocking position, and said actuator member engaging said actuator rod in a second relation upon rotation of said actuator member to a second position, thereby to move said damper plate to said second, unblocking position.

4. A venting system as claimed in claim 3 wherein said control means further includes overcenter spring means coupled between said actuator member and said manual control selector means, for positively rotating said actuator member between said first and second positions.

5. A venting system for expelling heated air from a food-processing oven or the like cooking appliance selectively to one of the exterior and interior of the household in which the oven is installed, said venting system including:

a duct assembly comprising a substantially enclosed housing, a first portion of said housing defining an inlet and first and second outlets, said inlet being in communication within an exhaust outlet of said oven, said first outlet being in communication with one of said household interior and exterior, a second housing portion including duct means having a predetermined cross sectional dimension and communicating with said first housing portion via said second outlet of said first housing portion, said second housing portion having an outlet communicating with the other of said household interior and exterior, a damper plate dimensioned similarly to the cross sectional dimension of said duct means, mounted in the latter for controlling the passage of heated oven air to the interior and exterior of said household, said damper plate being movable between a first position across the flow of air through said duct means for blocking the latter and a second position, generally in the direction of the flow of air through said duct means for unblocking the latter, means for biasing said damper plate to the second unblocking position, control means movable between a first closed position and a second open position, and damper plate actuator means mounted adjacent the damper plate and coupled to said control means, said damper plate actuator means being operable to a first position to move said damper plate to said first, blocking position in response to the movement of said control means to said closed position and, in response to the movement of said control means to said open position, said damper plate actuator means being operable to a second position to permit said damper plate to be biased to said second, unblocking position.

6. A venting system as claimed in claim 5 wherein said first housing portion of said duct assembly includes a series of parallel plates mounted adjacent each other to form passages therebetween, opposite ends of said plates being blocked to provide a serpentine shaped channel through which said oven heated air passes, the end of said channel opposite the inlet of said first housing portion communicating with said first outlet of said first housing portion.

7. A venting system as claimed in claim 5 wherein said control means includes a manual control selector movable between first and second positions, and wherein said damper plate actuator means includes an actuator rod mounted in said duct means adjacent said damper plate, movable into engagement with said damper plate for moving the latter to said blocking position and out of engagement with said damper plate for permitting said damper plate to be moved to said unblocking position, and further including means coupling said manual control selector and said actuator rod so that said actuator rod is moved into and out of engagement with said damper plate in response to the movement of said manual control selector between said first and second positions.

8. A venting system as claimed in claim 7 wherein said coupling means includes an actuator member mounted for rotation on said second housing portion adjacent said actuator rod, said actuator member being rotatable between first and second positions, said actuator member engaging said rod at a first location on said actuator member upon rotation to said first position and at a second location thereon upon rotation to said second position, whereby said actuator rod is moved between said first and second positions, respectively.

9. A venting system as claimed in claim 8 wherein said coupling means further includes overcenter spring means coupled between said manual selector means and said actuator member, said overcenter spring means positively rotating said actuator member to said first and second positions in response to the movement of said selector means to its first and second positions, respectively.

* * * * *